US010337362B2

(12) United States Patent
Sumer et al.

(10) Patent No.: US 10,337,362 B2
(45) Date of Patent: Jul. 2, 2019

(54) METHOD AND SYSTEM FOR VARIABLE CAMSHAFT TIMING CONTROL

(71) Applicant: Ford Global Technologies, LLC, Dearborn, MI (US)

(72) Inventors: Erol Dogan Sumer, Ann Arbor, MI (US); Yan Wang, Ann Arbor, MI (US); Mohammad Farid, London (GB); Dimitar Petrov Filev, Novi, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 182 days.

(21) Appl. No.: 15/453,797

(22) Filed: Mar. 8, 2017

(65) Prior Publication Data

US 2018/0258800 A1 Sep. 13, 2018

(51) Int. Cl.

| | |
|---|---|
| ***F01L 1/344*** | (2006.01) |
| ***F01L 1/053*** | (2006.01) |
| ***F01L 1/18*** | (2006.01) |
| ***F02D 13/02*** | (2006.01) |

(52) U.S. Cl.

CPC ..... *F01L 1/3442* (2013.01); *F01L 1/053* (2013.01); *F01L 1/18* (2013.01); *F01L 1/344* (2013.01); *F01L 2001/34426* (2013.01); *F01L 2201/00* (2013.01); *F01L 2800/00* (2013.01); *F01L 2820/041* (2013.01); *F02D 13/02* (2013.01)

(58) Field of Classification Search

CPC ..... F01L 1/3442; F01L 1/053; F01L 2001/34426; F01L 2820/041; F01L 2201/00

See application file for complete search history.

(56) References Cited

U.S. PATENT DOCUMENTS

| | | | | |
|---|---|---|---|---|
| 5,626,109 | A * | 5/1997 | Yasumura | F01L 1/34 123/90.15 |
| 5,738,053 | A * | 4/1998 | Kato | F01L 1/34406 123/90.15 |
| 6,571,757 | B1 | 6/2003 | Simpson | |
| 6,704,160 | B2 | 3/2004 | Takakura | |
| 8,714,123 | B2 | 5/2014 | Rollinger et al. | |
| 2010/0280739 | A1 * | 11/2010 | Rollinger | F01L 1/34 701/102 |
| 2014/0277999 | A1 | 9/2014 | Switkes et al. | |

OTHER PUBLICATIONS

Astrom, K.J., et al., "Real Time Parameter Estimation," Adaptive Control, Addison-Wesley, 1995, pp. 41-62, 22 pages.

Goodwin, G.C., et al., "Equation Error Methods for Deterministic Systems," Adaptive Filtering, Prediction and Control, Prentice Hall, 1984, pp. 50-68, 19 pages.

(Continued)

*Primary Examiner* — Mark A Laurenzi

*Assistant Examiner* — Wesley G Harris

(74) *Attorney, Agent, or Firm* — Julia Voutyras; McCoy Russell LLP

(57) ABSTRACT

Methods and systems are provided for controlling a variable camshaft timing system. In one example, a method may include actuating a camshaft phaser with a camshaft duty cycle determined based on a sampled camshaft position and an estimated camshaft position, the estimated camshaft position determined based on a previously determined camshaft duty cycle.

18 Claims, 5 Drawing Sheets

(56) References Cited

OTHER PUBLICATIONS

Ljung, L., et al., "Approaches to Recursive Identification," Theory and Practice of Recursive Identification, Cambridge, Mass: MIT Press, 1983, pp. 12-22, 11 pages.
Ren, Zhen, et al., "Multirate Closed-Loop System Identification of a Variable Valve Timing Actuator for an Internal Combustion Engine," 2010 American Control Conference, Baltimore, MD, WeA19.3, pp. 664-669, 6 pages.
Styron, Joshua P., "Using Model-Based Calibration Toolbox Multimodels for Cycle-Optimized Diesel Calibration," Ford Motor Company, 11 pages.

* cited by examiner

METHOD AND SYSTEM FOR VARIABLE CAMSHAFT TIMING CONTROL

FIELD

The present description relates generally to methods and systems for controlling a variable camshaft timing system.

BACKGROUND/SUMMARY

Internal combustion engines may use a variable camshaft timing (VCT) system to improve fuel economy and emission performance of a vehicle. The VCT system may be coupled to the intake and/or exhaust valve for advancing or retarding valve lift events. As an example, in an oil pressure actuated device, the VCT system may include an oil control valve (OCV) for adjusting an angular position (or camshaft position) of a camshaft phaser relative to the camshaft. The OCV may be actuated by an actuator controlled with a camshaft duty cycle based on a desired camshaft timing. The camshaft duty cycle needs to be closely controlled to meet the desired camshaft timing.

Other attempts to control the camshaft timing include adjusting a control signal to the VCT system based on feedback of a camshaft position. One example approach is shown by Simpson et al. in U.S. Pat. No. 6,571,757. Therein, a VCT phaser is activated by a spool valve. The spool valve position is controlled based on a feedback from a VCT phase measurement via a sensor.

However, the inventors herein have recognized potential issues with such systems. As one example, under certain conditions, the spool valve position may not be effectively controlled based on the feedback of the VCT phase measurement due to a low sampling rate of the VCT phase. The VCT phase, or the camshaft position, may be sampled when a camshaft trigger wheel edge on the camshaft phaser passes a camshaft position sensor. As the camshaft phaser, together with the camshaft trigger wheel edge, rotating with the camshaft relative to the non-rotating camshaft position sensor, the camshaft position is sampled discretely. The sampling period of the camshaft position is determined by both the engine speed and the number of camshaft trigger wheel edges on the camshaft phaser. For example, in a typical four-stroke engine VCT system, the sampling period T2 of the camshaft position may be expressed as:

$$T2 = \frac{60 \times 2}{\omega_{crank} \times N_{edges}},$$

wherein $\omega_{crank}$ denotes engine speed in RPM, and $N_{edges}$ denotes the number of camshaft trigger wheel edges. During low engine speed or when the rate of engine speed change is high, the camshaft position sampling period may be too long to effectively control the camshaft timing to meet the dynamic changes in the engine operating condition.

In one example, the issues described above may be addressed by a method comprising adjusting a camshaft phaser with a camshaft duty cycle determined based on a sampled camshaft position; and adjusting the camshaft phaser with an estimated camshaft position determined based on the camshaft duty cycle between sampling the camshaft position. In this way, the VCT system may be controlled with a sufficiently high frequency camshaft duty cycle signal at a greater range of engine operating conditions.

As one example, the camshaft timing may be adjusted by actuating the oil control valve of the VCT system with a camshaft duty cycle signal. If the engine speed is higher than a threshold, the camshaft duty cycle may be adjusted based on feedback of the sampled camshaft position and independent of an estimated camshaft position. If the engine speed is lower than the threshold, the camshaft duty cycle signal may be adjusted based on the sampled camshaft position and the estimated camshaft position, with the estimated camshaft position intermediate consecutive sampled camshaft positions. The estimated camshaft position may be calculated based on the most recent camshaft duty cycle signal via a model of the VCT system. The estimated camshaft position may predict the camshaft position between the actual camshaft position sampling instants. As such, the response time of the VCT control may be reduced, and system performance during transient operating conditions may be improved.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
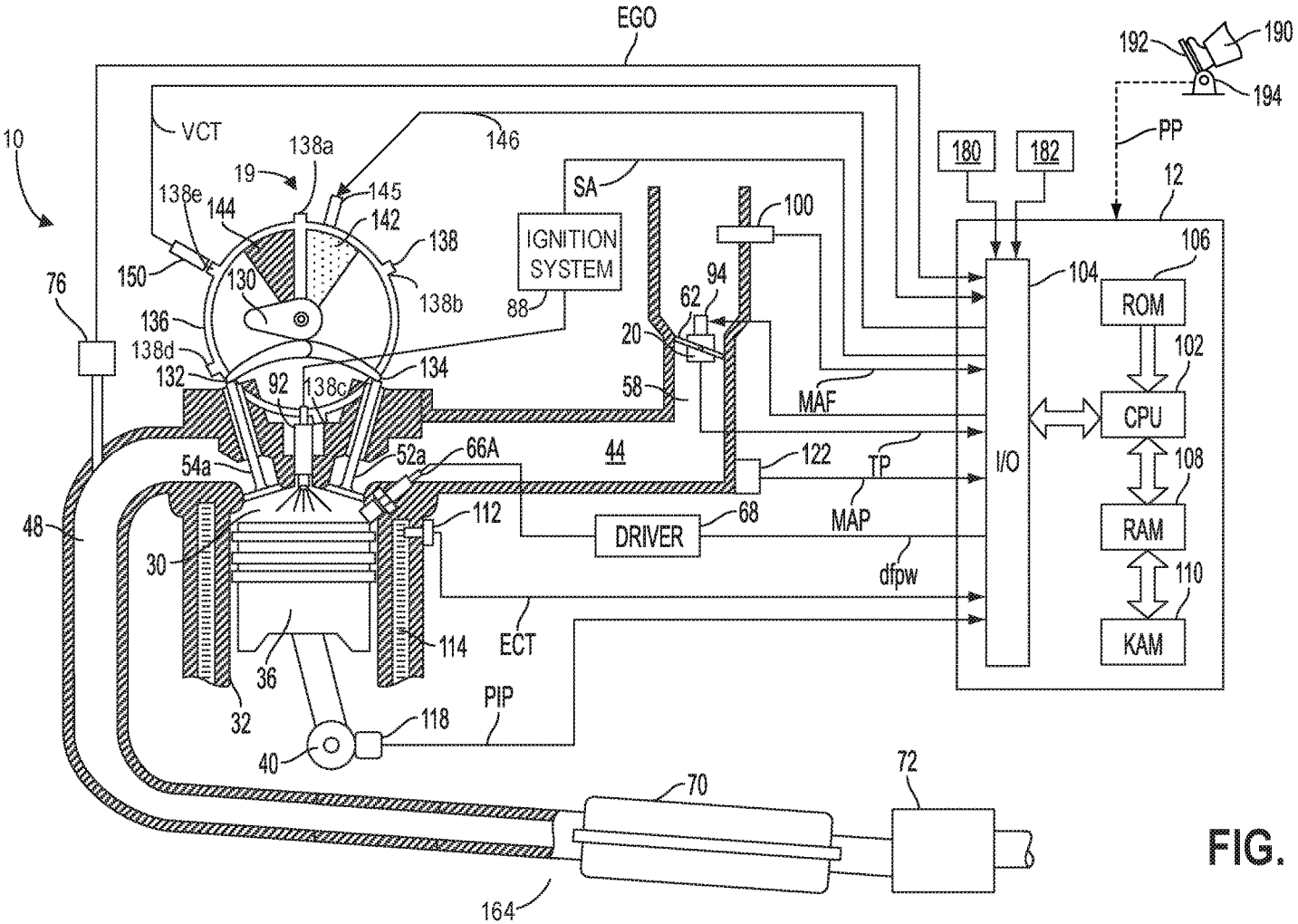
FIG. 1 shows an example engine system with a variable camshaft timing system.
Figure 2A:
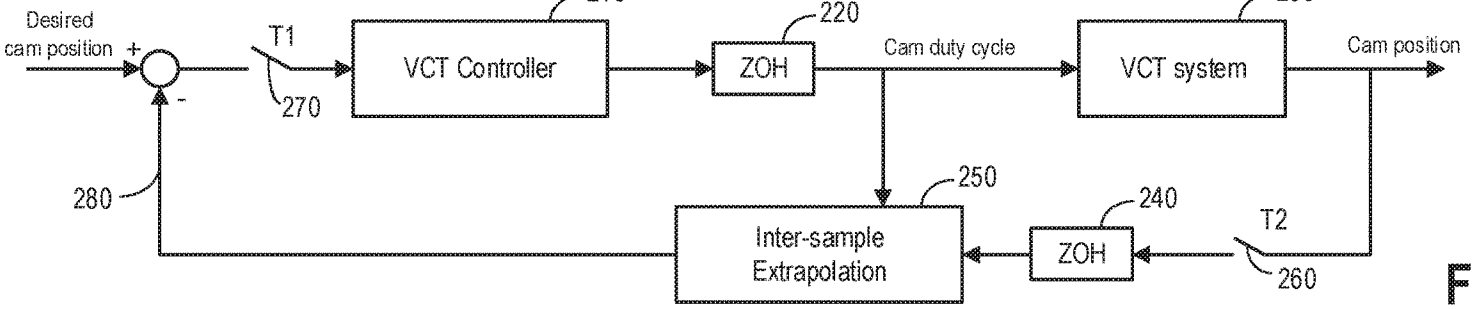
FIG. 2A shows a high level block diagram for camshaft timing control.
Figure 2B:
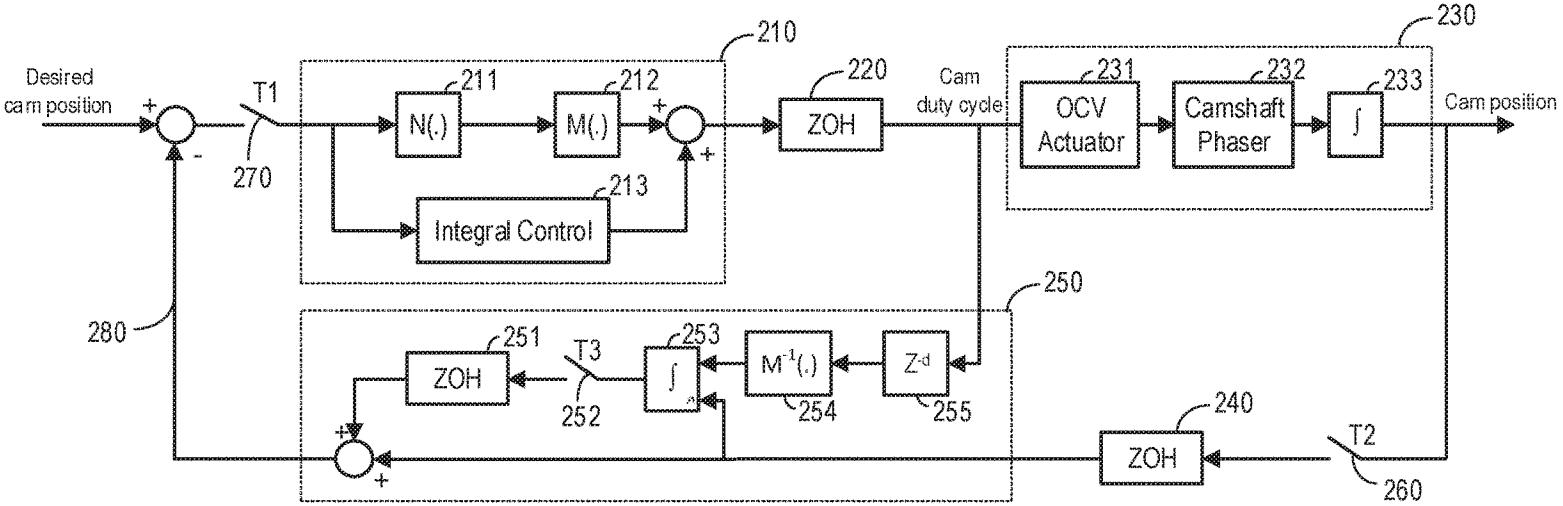
FIG. 2B shows a low level block diagram for camshaft timing control.
Figure 3:
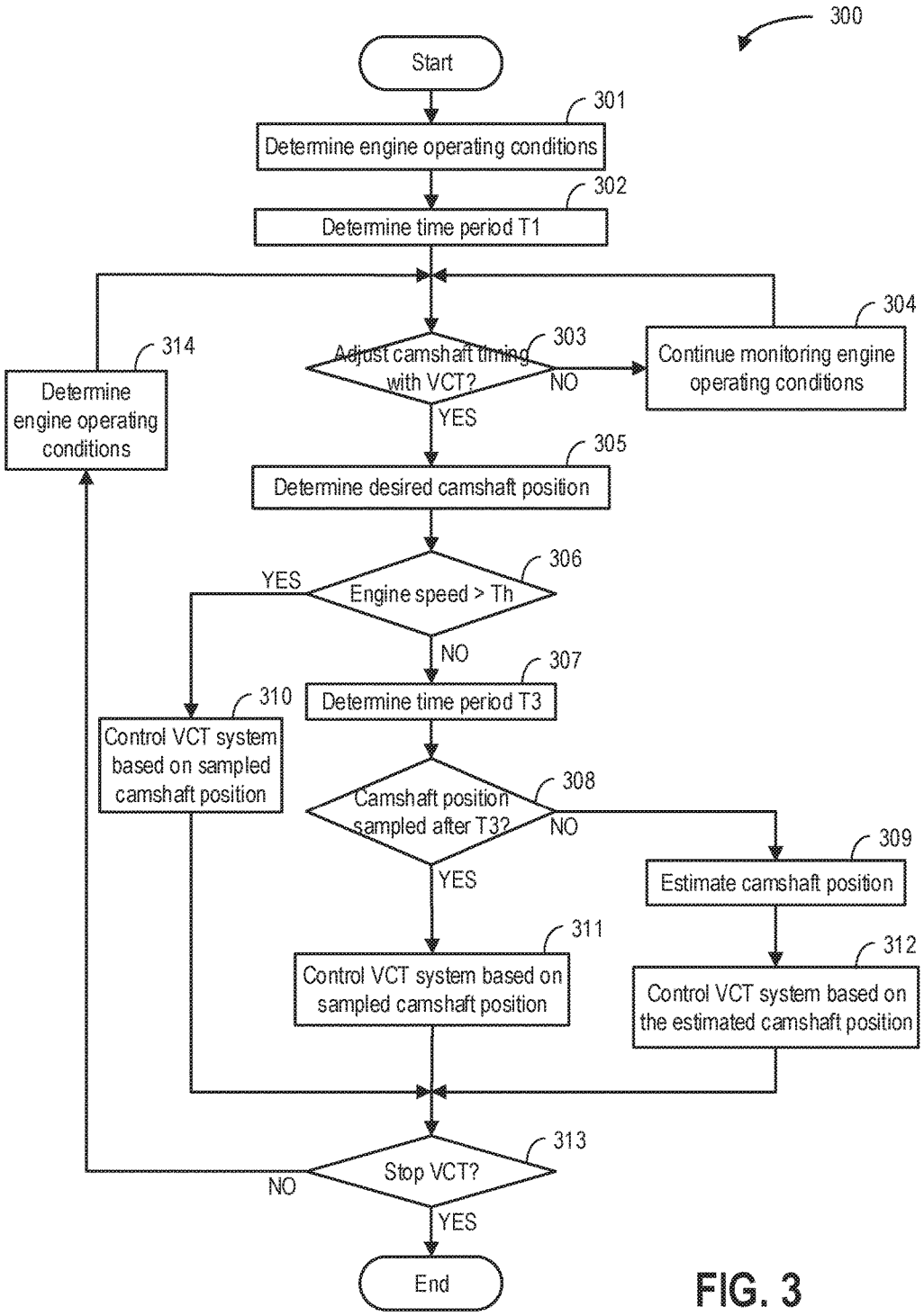
FIG. 3 shows an example method for controlling camshaft timing.
Figure 4:
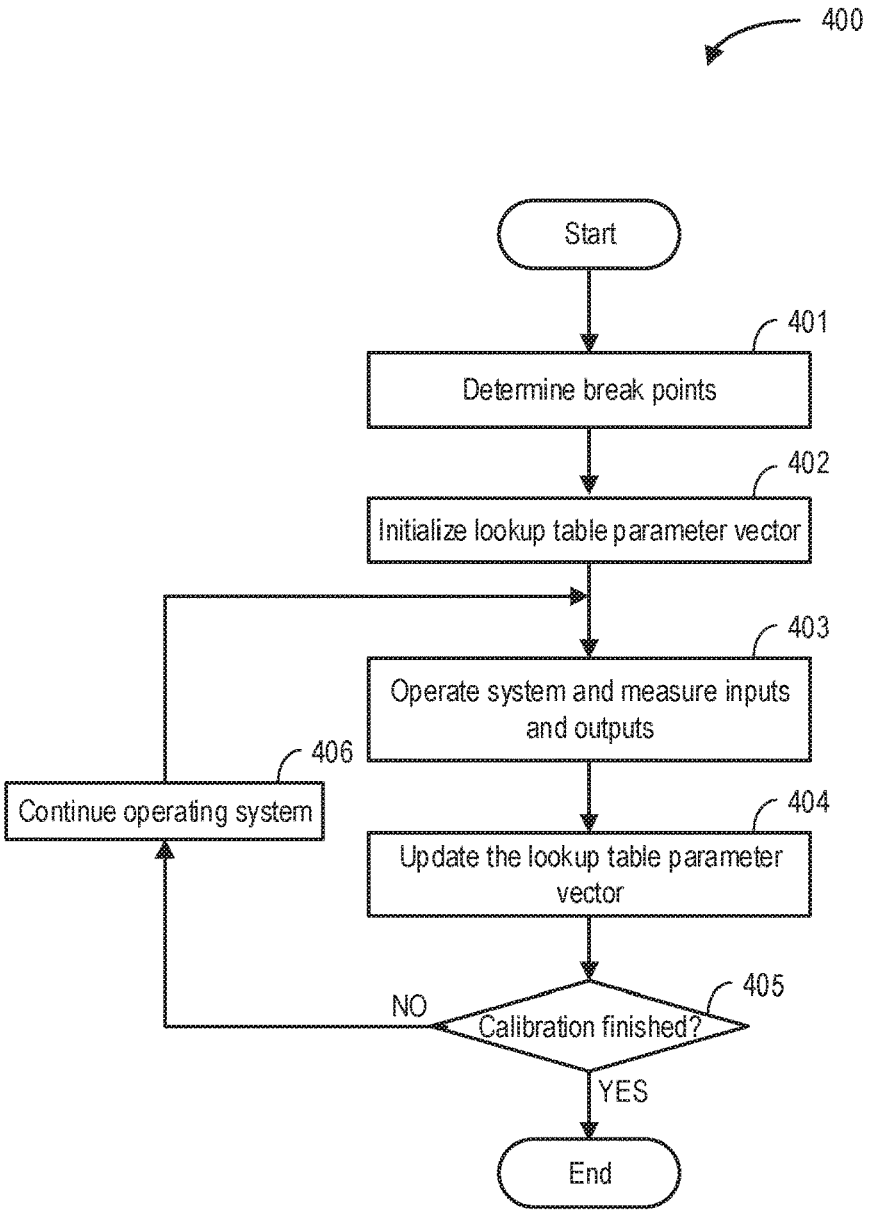
FIG. 4 shows an example method for calibrating a rate-to-duty-cycle operator of FIG. 2B.
Figure 5:
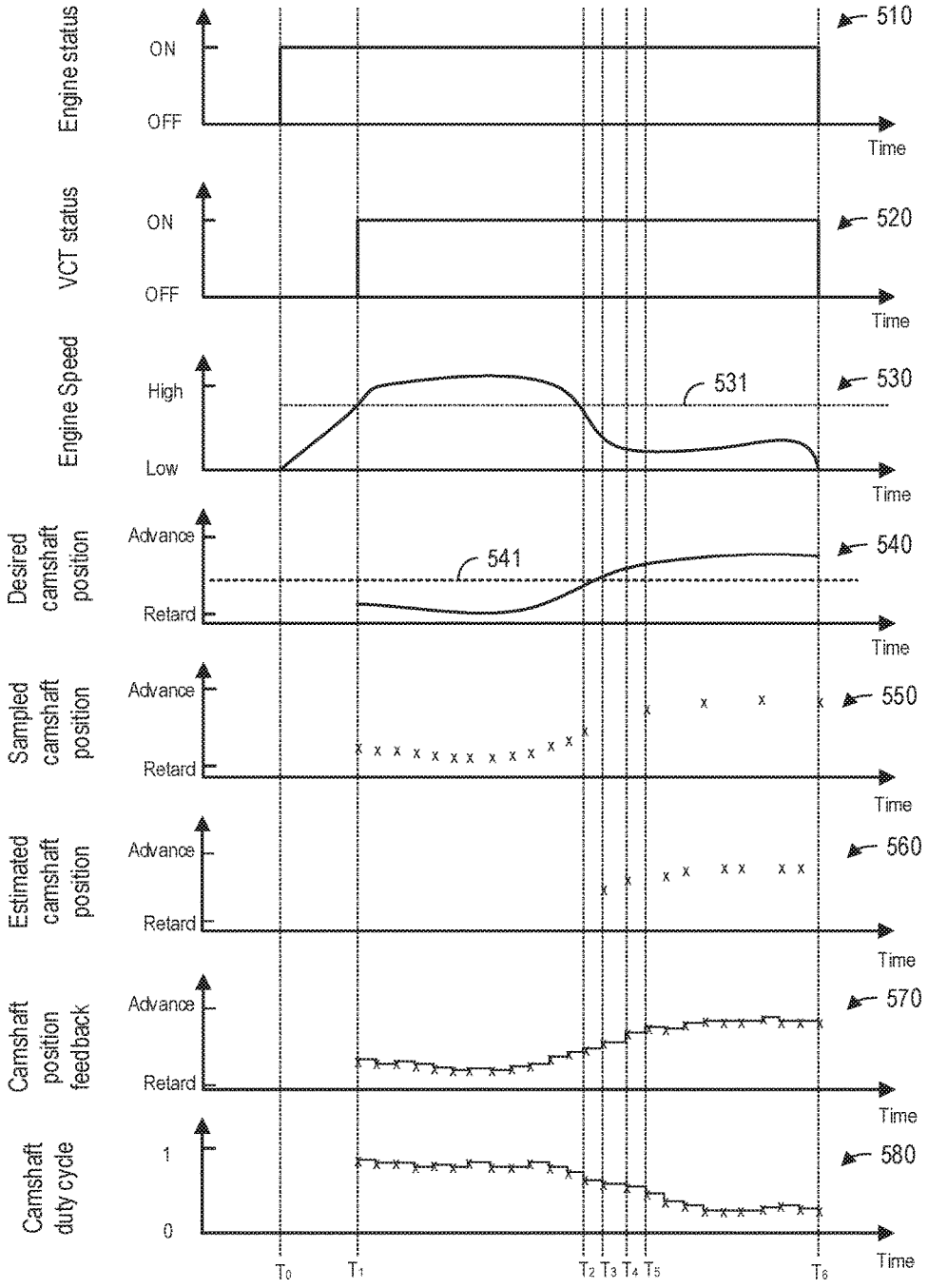
FIG. 5 shows timelines of engine operating parameters while implementing the method of FIG. 3.

The following description relates to systems and methods for adjusting camshaft timing by adjusting a camshaft phaser of a VCT system coupled to an internal combustion engine. An example internal combustion engine is shown in FIG. 1. The camshaft phaser may be adjusted by actuating an oil control valve (OCV) with a camshaft duty cycle signal. As shown in FIG. 2A, the camshaft duty cycle signal may be generated via a feedback control loop including a VCT controller. Details of the feedback control loop is shown in FIG. 2B. The feedback signal includes sampled camshaft position and estimated inter-sample camshaft position. The estimated camshaft position may be determined based on an inverted rate-to-duty cycle operator in the form of a lookup table. Procedures for calibrating the lookup table are shown in FIG. 4. FIG. 3 shows an example method for controlling the camshaft timing based on the feedback control loop of FIG. 2A-2B. The variations of engine operating parameters while implementing method of FIG. 3 are shown in FIG. 5.

FIG. 1 depicts an example embodiment of a combustion chamber or cylinder of internal combustion engine 10. Engine 10 may receive control parameters from a control system including controller 12, as well as input from a vehicle operator 190 via an input device 192. In this example, input device 192 includes an accelerator pedal and a pedal position sensor 194 for generating a proportional pedal position signal PP.

Cylinder (herein also "combustion chamber") 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of the passenger vehicle via a transmission system. Further, a starter motor may be coupled to crankshaft 40 via a flywheel to enable a starting operation of engine 10. Crankshaft 40 may be coupled to an oil pump to pressurize the engine oil lubrication system.

Cylinder 30 may receive intake air via intake manifold or air passages 44. Intake air passage 44 may communicate with other cylinders of engine 10 in addition to cylinder 30. In some embodiments, one or more of the intake passages may include a boosting device such as a turbocharger or a supercharger. A throttle system including a throttle plate 62 may be provided along an intake passage of the engine for varying the flow rate and/or pressure of intake air provided to the engine cylinders. In this particular example, throttle plate 62 is coupled to electric motor 94 so that the position of elliptical throttle plate 62 is controlled by controller 12 via electric motor 94. This configuration may be referred to as electronic throttle control (ETC), which can also be utilized during idle speed control.

Combustion chamber 30 is shown communicating with intake manifold 44 and exhaust manifold 48 via respective intake valves 52*a* and 52*b* (not shown), and exhaust valves 54*a* and 54*b* (not shown). Thus, while four valves per cylinder may be used, in another example, a single intake and single exhaust valve per cylinder may also be used. In still another example, two intake valves and one exhaust valve per cylinder may be used.

Camshaft timing is controlled by a variable camshaft timing (VCT) system 19. In this example, an overhead camshaft system is illustrated, although other approaches may be used. Specifically, camshaft 130 of engine 10 is shown communicating with rocker arms 132 and 134 for actuating intake valves 52*a*, 52*b* and exhaust valves 54*a*, 54*b*. VCT system 19 may be oil-pressure actuated (OPA), cam-torque actuated (CTA), a combination thereof OPA and CTA, or electrically actuated. By adjusting a plurality of oil control valves (OCVs) 145 to thereby direct a hydraulic fluid, such as engine oil, into the cavity (such as an advance chamber or a retard chamber) of a camshaft phaser, valve timing may be changed, that is advanced or retarded. For electrically actuated VCT, the control of the valve timing is realized by adjusting the torque to the electric motor with motor current, which is a similar control paradigm to hydraulic actuators. Herein, controlling of the hydraulic actuators is presented as an example. As further elaborated herein, the operation of the hydraulic control valves may be controlled by respective control solenoids. Specifically, an engine controller may transmit a camshaft duty cycle signal 146 to the solenoids to move a valve spool that regulates the flow of oil through the camshaft phaser cavity. As used herein, advance and retard of camshaft timing refer to relative camshaft timings, in that a fully advanced position may still provide a retarded intake valve opening with regard to top dead center, as just an example.

Camshaft 130 is hydraulically coupled to housing 136. Housing 136 forms a toothed wheel having a plurality of camshaft trigger wheel edges 138. In the example embodiment, housing 136 is mechanically coupled to crankshaft 40 via a timing chain or belt (not shown). Therefore, housing 136 and camshaft 130 rotate at a speed substantially equivalent to each other and synchronous to the crankshaft. In an alternate embodiment, as in a four stroke engine, for example, housing 136 and crankshaft 40 may be mechanically coupled to camshaft 130 such that housing 136 and crankshaft 40 may synchronously rotate at a speed different than camshaft 130 (e.g. a 2:1 ratio, where the crankshaft rotates at twice the speed of the camshaft). In the alternate embodiment, camshaft trigger wheel edges 138 may be mechanically coupled to camshaft 130. By manipulation of the hydraulic coupling as described herein, the relative position of camshaft 130 to crankshaft 40 can be varied by hydraulic pressures in retard chamber 142 and advance chamber 144. By allowing high pressure hydraulic fluid to enter retard chamber 142, the relative relationship between camshaft 130 and crankshaft 40 is retarded. Thus, intake valves 52*a*, 52*b* and exhaust valves 54*a*, 54*b* open and close at a time later than normal relative to crankshaft 40. Similarly, by allowing high pressure hydraulic fluid to enter advance chamber 144, the relative relationship between camshaft 130 and crankshaft 40 is advanced. Thus, intake valves 52*a*, 52*b*, and exhaust valves 54*a*, 54*b* open and close at a time earlier than normal relative to crankshaft 40. In another embodiment, the intake valve and the exhaust valve may each be coupled with a VCT system so that the intake and exhaust valve timing may be independently adjusted.

While this example shows a system in which the intake and exhaust valve timing are controlled concurrently, variable intake camshaft timing, variable exhaust camshaft timing, dual independent variable camshaft timing, dual equal variable camshaft timing, or other variable camshaft timing may be used. Further, variable valve lift may also be used. Further, camshaft profile switching may be used to provide different camshaft profiles under different operating conditions. Further still, the valve train may be roller finger follower, direct acting mechanical bucket, electrohydraulic, or other alternatives to rocker arms.

Continuing with the variable camshaft timing system, camshaft trigger wheel edges 138, rotating synchronously with camshaft 130, allow for measurement of relative camshaft position via camshaft position sensor 150 providing signal VCT to controller 12. Camshaft trigger wheel edge 138*a*, 138*b*, 138*c*, and 138*d* may be used for measurement of camshaft timing and are equally spaced (for example, in a V-8 dual bank engine, spaced 90 degrees apart from one another) while camshaft trigger wheel edge 138*e* may be used for cylinder identification. Controller 12 sends camshaft duty cycle signals 146 to oil control valves 145 to control the flow of hydraulic fluid either into retard chamber 142, advance chamber 144, or neither.

Relative camshaft timing can be measured in a variety of ways. In general terms, the time, or rotation angle, between the rising edge of the PIP signal and receiving a signal from one of the plurality of camshaft trigger wheel edges 138 on housing 136 gives a measure of the relative camshaft timing. For the particular example of a V-8 engine, with two cylinder banks and a wheel including five camshaft edges, a measure of camshaft timing for a particular bank may be received four times per revolution, with the extra signal used for cylinder identification.

Exhaust manifold 48 can receive exhaust gases from other cylinders of engine 10 in addition to cylinder 30. Exhaust gas sensor 76 is shown coupled to exhaust manifold 48 upstream of catalytic converter 70 (where sensor 76 can correspond to various different sensors). For example, sensor 76 may be any of many known sensors for providing an indication of exhaust gas air/fuel ratio such as a linear oxygen sensor, a UEGO, a two-state oxygen sensor, an EGO, a HEGO, or an HC or CO sensor. Emission control device 72 is shown positioned downstream of catalytic converter 70. Emission control device 72 may be a three-way catalyst, a NOx trap, various other emission control devices or combinations thereof.

In some embodiments, each cylinder of engine 10 may include a spark plug 92 for initiating combustion. Ignition system 88 can provide an ignition spark to combustion chamber 30 via spark plug 92 in response to spark advance signal SA from controller 12, under select operating modes. However, in some embodiments, spark plug 92 may be omitted, such as where engine 10 may initiate combustion by auto-ignition or by injection of fuel, as may be the case with some diesel engines.

In some embodiments, each cylinder of engine 10 may be configured with one or more fuel injectors for providing fuel thereto. As a non-limiting example, fuel injector 66A is shown coupled directly to cylinder 30 for injecting fuel directly therein in proportion to the pulse width of signal dfpw received from controller 12 via electronic driver 68. In this manner, fuel injector 66A provides what is known as direct injection (hereafter also referred to as "DI") of fuel into cylinder 30.

Controller 12 is shown as a microcomputer, including microprocessor unit 102, input/output ports 104, an electronic storage medium for executable programs and calibration values shown as read only memory chip 106 in this particular example, random access memory 108, keep alive memory 110, and a conventional data bus. Controller 12 is shown receiving various signals from sensors coupled to engine 10, in addition to those signals previously discussed, including measurement of inducted mass air flow (MAF) from mass air flow sensor 100 coupled to throttle 62; engine coolant temperature (ECT) from temperature sensor 112 coupled to cooling sleeve 114; a profile ignition pickup signal (PIP) from Hall effect sensor 118 coupled to crankshaft 40; throttle position TP from throttle position sensor 20; absolute manifold pressure MAP from sensor 122; and camshaft position VCT from camshaft position sensor 150. Engine speed signal RPM may be estimated by controller 12 from signal PIP in a conventional manner. The manifold pressure signal MAP from a manifold pressure sensor provides an indication of vacuum, or pressure, in the intake manifold. During stoichiometric operation, the manifold pressure sensor may give an indication of engine load. Further, the manifold pressure sensor, along with the estimated engine speed, can provide an estimate of charge (including air) inducted into the cylinder. Based on the received signals from the various sensors and instructions stored on a memory of the controller, controller 12 may employ various actuators to adjust engine operation. For example, adjusting camshaft timing may include adjusting the camshaft duty cycle signal 146 to the OCV 145 based on camshaft position signal VCT received from camshaft position sensor 150.

As described above, FIG. 1 merely shows one cylinder of a multi-cylinder engine, and that each cylinder has its own set of intake/exhaust valves, fuel injectors, spark plugs, etc.

FIGS. 2A and 2B are block diagrams demonstrating example feedback control of camshaft timing. The feedback control loop may include a VCT controller. The camshaft position from the VCT system may be sampled and extrapolated before feeding back to the input of the VCT controller.

FIG. 2A shows a high level block diagram of the feedback control loop. The VCT system 230 may be controlled by a camshaft duty cycle signal generated by a VCT controller 210. The VCT system outputs a camshaft position, which is sampled by a sensor (such as camshaft position sensor 150 of FIG. 1) at a time period of T2. The sampled camshaft position passes through a zero-order holder 240 and inputs to an inter-sample extrapolation module 250. Based on the camshaft duty cycle and the sampled camshaft position, inter-sample extrapolation module 250 outputs a camshaft position feedback signal 280 including the sampled camshaft position and an estimated camshaft position signal intermediate consecutive sampled camshaft positions. Output of the inter-sample extrapolation module 250 may then be compared with a desired camshaft position to generate a camshaft position error signal. The camshaft position error signal is digitized at a time period of T1 before entering the VCT controller 210. T1 may be the shortest time period achievable by the VCT controller due to program execution time and task scheduling constraints in the CPU 102, where the VCT controller tasks are executed. The output of the VCT controller 210 is a camshaft duty cycle signal. The camshaft duty cycle may be converted to an analog signal via a zero-order holder 220 for actuating the VCT system. The camshaft duty cycle sent to the VCT system is updated at a time period of T1. Under certain conditions, such as low engine speed, the sampling time period T2 of camshaft position may be longer than the operating time period T1 of the VCT controller. As such, the VCT system may be controlled at a frequency higher than the camshaft position sensor sampling frequency to ensure fast control response.

FIG. 2B is a low level block diagram showing details of the VCT controller 210, the VCT system 230, and the inter-sample extrapolation module 250. The system illustrates continuous time and discrete-time operations.

The VCT controller 210 may include an error-to-rate operator 211 in series connection with a rate-to-duty-cycle operator 212. The VCT controller 210 may further include an integral control module 213 in parallel connection with the error-to-rate operator and the rate-to-duty-cycle operator. The VCT controller 210 operates at a fixed task rate of 1/T1. The error-to-rate operator 211 may convert the camshaft position error to a desired angular rate of the camshaft phaser. As an example, the error-to-rate operator may be a predetermined lookup table. As another example, the error-to-rate operator may simply be a gain operator. The rate-to-duty-cycle operator 212 may be an inverted non-linear model of the variable camshaft timing system, which converts the desired angular rate output from the error-to-rate operator to a camshaft duty cycle. The rate-to-duty-cycle operator may be a lookup table. The lookup table may be calibrated in factory, or online while operating the vehicle. The rate-to-duty-cycle operator 212 is monotonic, and thus invertible. FIG. 4 shows an example method of calibrating the rate-to-duty-cycle operator.

The VCT system may include an OCV 231, a camshaft phaser 232, and an integration operator 233 connected in series. The input to the OCV is a pulse width modulated voltage defined by a fixed voltage level and a camshaft duty cycle. The output of the OCV is an oil flow rate. As engine oil flows into a chamber of the camshaft phaser 232, the angular rate of the camshaft phaser is adjusted. After integrating the angular rate, integration operator 233 outputs the camshaft position.

The inter-sample extrapolation module 250 comprises delay module 255, inverted rate-to-duty-cycle operator 254, edge triggered integrator 253, switch 252, and zero-order holder 251 in series connection. The camshaft duty cycle generated by the VCT controller via zero-order holder is first delayed by time d via delay module 255. The delay may compensate for known time delays in the VCT system. The inverted rate-to-duty-cycle operator 254 is the inverted non-linear model of the variable camshaft timing system. In other words, the inverted rate-to-duty-cycle operator 254 is the inverted form of operator 212. The inverted rate-to-duty-cycle operator 254 outputs an estimated angular rate of the camshaft phaser based on the delayed camshaft duty cycle. The edge triggered integrator 253 may be triggered by the output of zero-order holder 240. Whenever the reading of the camshaft position sensor is updated or the camshaft position is sampled, edge triggered integrator 253 starts to integrate the estimated angular rate of the camshaft phaser and generates an estimated change in the camshaft position. The output of edge triggered integrator 253 is sampled at a sampling period of T3 and added to the sensed camshaft position after zero-order holder 251. In this way, the sensed camshaft position is updated at a time period of T3. The camshaft position feedback 280 equals to the sensed camshaft position when the sensed camshaft position is updated. The camshaft position feedback 280 equals to the estimated camshaft position when there is no change in the sensed camshaft position. The estimated camshaft position is calculated by adding the sensed camshaft position with the estimated change in camshaft position. As one example, T3 is shorter than T2, so that the camshaft position feedback 280 has a broader bandwidth comparing to the feedback based on only the sampled camshaft position. As another example, T3 may be set equal to T1, so that the bandwidth of the camshaft position feedback equals to the bandwidth theoretically achievable by the VCT controller 210.

Block 250 operates in such a way that upon receipt of each new or updated cam duty cycle, the output is an integrated estimate of the cam position in such a way that an estimated cam position is formed until a new reading of the actual cam position is received. The estimated cam position is then completely replaced by the measured cam position. It should be appreciated that multiple updates to the estimated cam position may occur upon receipt of an updated cam duty cycle command, and further even more updates to the estimated cam position may occur upon receipt of still further updated cam duty cycle commands, before receipt of an updated actual cam position.

FIG. 3 shows an example method 300 for controlling the camshaft timing based on the block diagram of FIGS. 2A and 2B. The OCV is actuated with a camshaft position feedback including camshaft position sensed by a sensor and an estimated camshaft position based on a model of the VCT system.

Instructions for carrying out method 300 and the rest of the methods included herein may be executed by a controller based on instructions stored on a memory of the controller and in conjunction with signals received from sensors of the engine system, such as the sensors described above with reference to FIG. 1. The controller may employ engine actuators of the engine system to adjust engine operation, according to the methods described below.

At 301, engine operating conditions may be determined by a controller (such as controller 12 of FIG. 1). The controller acquires measurements from various sensors in the engine system and estimates operating conditions including engine load, engine torque demand, engine speed, engine crankshaft angle, engine spark timing, engine coolant temperature, and ambient temperature. The controller may determine desired camshaft position based on the measurements.

At 302, method 300 may optionally determine time period T1. Time period T1 may be the ideal time period for actuating the VCT system. In another example, time period T1 may also be determined by the bandwidth theoretically achievable by a controller seriesly coupled to the VCT system (such as VCT controller 210).

At 303, method 300 determines whether the camshaft timing needs to be adjusted by the VCT system. Method 300 may determine whether to adjusting camshaft timing based on engine speed, engine temperature, engine load, and time since engine start. As one example, method 300 may adjust the camshaft timing via the VCT system if the engine speed exceeds a threshold. As another example, method 300 may adjust the camshaft timing via the VCT system if the engine torque is lower than a threshold. As another example, method 300 may lock the camshaft phaser to a basic camshaft location during engine start and/or engine stop. If the controller determines to adjust the camshaft timing, method 300 moves to 305. If the controller determines not to adjust the camshaft timing, method 300 moves to 304, wherein method 300 continues monitoring engine operating conditions.

At 305, method 305 determines the desired camshaft position based on engine operating conditions including, for example, engine temperature, engine speed, and engine load.

At 306, method 300 determines whether the engine speed exceeds a threshold. As one example, the threshold may be determined based on time period T1. If the engine speed is higher than the threshold, the camshaft position may be sampled by the camshaft position sensor at a period shorter than the time period T1. Under this condition, there is no need to extrapolate the sampled camshaft position, and only the sampled camshaft position, but not the estimated camshaft position, is used for feedback control at 310. If the engine speed is less than the threshold, method 300 moves to 307. Alternatively, method 300 may determine to extrapolate the sampled camshaft position during transient engine operating. For example, method 300 may estimate the camshaft position intermediate the sampled camshaft positions in response to the change in engine speed over time (for example, rpm/second) being higher than a threshold.

At 307, method 300 determines the time period T3 for updating the sampled camshaft position to obtain the camshaft position feedback. The time period T3 may be the sampling time period of switch 252 in FIG. 2B. As one example, the time period T3 may equal to the VCT controller output frequency T1. As another example, the time period T3 may be shorter than the camshaft position sampling frequency (T2 of FIG. 2B).

At 308, method 300 determines whether the camshaft position has been sampled after time period T3. If the camshaft position is sampled, method 300 moves to 311, wherein the VCT system is controlled based on the sampled camshaft position. If the camshaft position is not sampled after time period T3, method 300 moves to 309.

At 309, method 300 estimates a camshaft position based on a previously determined camshaft duty cycle for actuating the OCV. As one example, method 300 may estimate the camshaft position by adding the sampled camshaft position with an estimated change in camshaft position. The estimated change in camshaft position may be generated by a model of the VCT system (such as the inverted rate-to-duty-cycle operator 254) taking the duty cycle updated at a previous time point as an input. Alternatively, if there exists a known time delay d in the OCV actuator, then the estimated change in camshaft position may be generated by a model of the VCT system (such as the inverted rate-to-duty cycle operator 254) taking the d-steps shifted camshaft duty cycle output of the delay module 255 as an input. FIG. 4 shows procedures for calibrating the VCT model.

At 312, the VCT system may be controlled based on the estimated camshaft position from 309.

At 313, method 300 determines whether to stop controlling the camshaft timing based on the VCT system. As one example, method 300 may stop controlling the camshaft timing based on the VCT system in response to engine stop. If the controller determines to stop VCT, method 300 may move to 314 to determine engine operating conditions. Otherwise, method 300 exits.

FIG. 4 shows an example method 400 for calibrating a lookup table M for a multiple input system. The method may be used for online or offline adaptation of a multiple-input single-output (MISO) or a multiple-input multiple-output (MIMO) system.

Let M: $u \rightarrow y$ represent an m×1 lookup table function, where the input vector is $u=[u_1 \ldots u_m]^T \in R^m$, and the output variable is $y \in R$. The lookup table M is parameterized by the input breakpoint coefficients $u_{i,j_i} \in R$ with $i \in \{1, \ldots, m\}$ and $j_i \in \{1, \ldots, l_i\}$ where $l_i$ represents the number of breakpoints for the $i^{th}$ input and the lookup table output coefficients $\theta_{j_1}, \ldots, j_m \in R$ corresponding to each point $(j_1, \ldots, j_m)$ in $R^m$. Herein, it is assumed that for each $u_i$ the input breakpoints are indexed as monotonically increasing coefficients, that is, $u_{i,1}<u_{i,2}< \ldots <u_{i,j_i}$. If each input $u_i$ in the input vector u is collocated with an input breakpoint such that $u=[u_{1,j_1} \ldots u_{m,j_m}]^T$, then the output of the lookup table is given by $y=j_1, \ldots, j_m$. Otherwise, the output is generated by interpolating between input breakpoints. If linear interpolation is used, then the output of the lookup table is a function of the adjacent $2^m$ input breakpoints. If higher order interpolation methods are used, then the output of the lookup table may be a function of the adjacent breakpoints as well as a combination of the non-adjacent breakpoints.

The rate-to-duty-cycle operator (such as 212 of FIG. 2B) is calibrated herein as a non-limiting example. The rate-to-duty-cycle operator may be in the form of a MISO lookup table. The inputs include the angular rate (or VCT rate) of the camshaft phaser of the VCT system and the engine oil temperature ($u_2$). The output of the lookup table is the duty cycle. Herein, offline calibration of the rate-to-duty-cycle operator is presented as a non-limiting example.

At 401, method 400 determines the break points of the lookup table. Specifically, ranges of the VCT rate ($u_1$) and the engine oil temperature ($u_2$) are determined, and representative break points within the input range are selected. As an example, the breakpoints may be [−100-50-25 0 25 50 100] deg/s for $u_1$, and [100 150 200] deg F for $u_2$.

At 402, method 400 initializes a lookup table parameter vector $\hat{\theta}(0)$, which can be constructed by stacking the initial guesses $\hat{\theta}j_1, j_2$ (0) for the output coefficients $\theta j_1, j_2$ into a column vector $$\hat{\theta}(0) \triangleq \begin{bmatrix} \hat{\theta}_{1,1}(0) \\ \vdots \\ \hat{\theta}_{l_1,1}(0) \\ \hat{\theta}_{1,2}(0) \\ \vdots \\ \hat{\theta}_{l_1,2}(0) \\ \vdots \\ \hat{\theta}_{1,l_2}(0) \\ \vdots \\ \hat{\theta}_{l_1,l_2}(0) \end{bmatrix} \in R^{(l1*l2)}, \quad \text{Equation 1}$$

where the initial guesses for the output coefficients may be provided by a baseline calibration available a priori, or may be set equal to arbitrary numerical values. The accuracy at which the initialized lookup table parameter vector matches the parameters of the ideal lookup table M may determine the duration of the online calibration method 400.

At 403, method 400 operates the system and measures the inputs and outputs of the system. Method 400 may drive the system to cover the full operating range of the system. As an example, a controller (such as controller 12 of FIG. 1) may operate the VCT system with a varied cam duty cycle at a varied engine oil temperature. The cam duty cycle may be varied within a duty cycle profile covering the operating range of the OCV. Alternatively, the cam duty cycle may be varied indirectly by adding a small excitation signal to the desired cam position within the operating range of the OCV and the housing 136. The engine oil temperature may be varied within an engine oil range covering the range of engine oil temperature during various engine operations. The VCT rate $u_1$ and the engine oil temperature $u_2$ are measured while operating the VCT system. At each iteration k, for the measured input vector $u(k)=[u_1 (k) \; u_2 (k)]^T$, method 400 constructs the regressor vector $$\varphi(u(k)) \triangleq \begin{bmatrix} d_{1,1}(u(k)) \\ \vdots \\ d_{l_1,1}(u(k)) \\ d_{1,2}(u(k)) \\ \vdots \\ d_{l_1,2}(u(k)) \\ \vdots \\ d_{1,l_2}(u(k)) \\ \vdots \\ d_{l_1,l_2}(u(k)) \end{bmatrix} \in R^{(l_i)}, \quad \text{Equation 2}$$

where $d_{j_1,j_2}$ (u(k)) are weighting functions that returns a scalar value representative of the distance of the input u(k) from the input breakpoints $u_{1,j_1}$, $u_{2,j_1+1}$, $u_{2,j_2}$ and $u_{2,j_2+1}$. Mathematical characteristics of the weighting functions depend on the interpolation method used by the lookup table operation. In general, d(.,.) must be chosen so that the output y(k) of the lookup table M with the input vector u(k) is given by $$y(k)=\theta^T\varphi(u(k)). \quad \text{Equation 3}$$

where θ is the vector constructed by stacking the output coefficients $\theta_{j_1,j_2}$ of the lookup table M, that is, similar to the right hand side of the Equation 1 with $\hat{\theta}_{j_1,j_2}$ (0) replaced with $\theta_{j_1,j_2}$.

At 404, the lookup table parameter vector may be updated. The lookup table parameter vector may be updated by a recursive adaptive algorithm. Examples to such algorithms include normalized least mean squares (NLMS) method, recursive least square (RLS) method, and so on. Such recursive adaptive algorithms are well-documented in the literature.

At 405, method 400 determines if the calibration is ended. As one example, calibration may end if the change in the lookup table parameter vector between consecutive iteration is less than a threshold. If calibration ends, method 400 exits. Otherwise, method 400 moves to 406 and continues operating the system at 406 to update the lookup table parameter vector.

In another embodiment, the calibrated lookup table parameters may be adapted online during the vehicle operation. For example, during engine operation, the controller may measure the engine oil temperature and the VCT rate. The lookup table parameter vector may be updated online based on the cam duty cycle, the measured engine oil temperature, and the measured VCT rate. As such, the offline calibration may be avoided. As another example, the pre-calibrated lookup table may be further adjusted online with the measured engine oil temperature and VCT rate. The online adaptation may improve lookup table accuracy and vehicle performance. Further, the online adaptation may increase the lookup table's robustness to time-varying operating conditions as well as part to part variations.

FIG. 5 shows the variation of engine operating parameters over time while implementing method 400. The x-axes indicate time. Engine status 510 may be on or off. The engine status may be estimated in response to a key-on event. VCT system status 520 may be one or off. A controller (such as controller 12 of FIG. 1) may determine whether to operate the VCT system to adjust the camshaft timing. Engine speed 530 increases as indicated by the arrow of y-axis. The desired camshaft position 540 may retard or advance relative to a basic camshaft position 541. The sampled camshaft position 550 is the reading from a camshaft position sensor (such as camshaft position sensor 150 of FIG. 1). The sampled camshaft position may be updated with a time period in response to engine speed. Each cross of 550 indicates the time point when the camshaft position is sampled. The estimated camshaft position 560 is a signal generated by an inter-sample extrapolation module (such as inter-sample extrapolation module 250 of FIG. 2A). The estimated camshaft position may be calculated based on the camshaft duty cycle. For example, the estimated camshaft position may be calculated by adding a change in camshaft position with the sampled camshaft position. The change in camshaft position may be calculated via an inverted rate-to-duty-cycle operator (such as inverted rate-to-duty-cycle operator 254 of FIG. 2B) based on the camshaft duty cycle. The camshaft position feedback 570 may be obtained by zero-order holding the sampled camshaft position and the estimated camshaft position. The camshaft position feedback (such as camshaft position feedback 280 of FIG. 2A) may be compared with the desired camshaft position to generate a camshaft position error for inputting to a VCT controller (such as VCT controller 210 of FIG. 2A). The camshaft duty cycle 580 for actuating the VCT system ranges from zero to one as indicated by the y-axis.

At $T_0$, the engine is turned on, and the engine speed starts to increase from zero speed.

At $T_1$, in response to engine speed higher than a threshold 531, the controller determines to control the camshaft timing via the VCT system. For example, the controller may unlock the VCT system from the basic camshaft position, and start adjusting the camshaft timing by injecting engine oil to the advance or retard chamber of the camshaft phaser. The camshaft position sensor starts to sense the time position as shown in 550. From $T_1$ to $T_2$, since engine speed is higher than a threshold, the camshaft position feedback is the same as the sampled camshaft position.

At $T_2$, engine speed decreases. Due to decreased engine speed, the sampled camshaft position is updated at a longer time period. Between $T_2$ and $T_5$, the camshaft position is not sampled. The inter-sample extrapolation module starts to generate estimated camshaft position 560 based on the previously updated camshaft duty cycle signal.

At $T_3$, after a time period (such as time period T3 of FIG. 2B), the estimated camshaft position is determined based on the previously updated camshaft duty cycle signal at $T_2$ and the previously sampled camshaft position at $T_2$. The estimated camshaft position is used as the camshaft position feedback and generates the camshaft duty signal at $T_3$. At $T_4$, the estimated camshaft position is determined based on the previously updated camshaft duty cycle signal at $T_3$ and the previously sampled camshaft position at $T_2$. At $T_5$, the camshaft position is sampled, and the sampled camshaft position is used for camshaft position feedback. As such, the camshaft position feedback may be updated frequently to reflect the variation in camshaft position.

At $T_6$, the engine is stopped, and the VCT system is turned off. As an example, the VCT system may be turned off by locking the camshaft phaser to a basic camshaft position.

In this way, the camshaft timing may be accurately controlled by extrapolating the sampled camshaft position based on the camshaft duty cycle sending to the OCV valve. The technical effect of extrapolating the sampled camshaft position based on the camshaft duty cycle is that the response of the feedback control loop may be fast with smaller overshoot comparing to using only the sampled camshaft position for feedback control. The technical effect of estimating the camshaft position based on the rate-to-duty-cycle operator is that change in the camshaft position may be estimated intermediate cam position samplings with a calibrated system model. The technical effect of online adapting the rate-to-duty-cycle operator includes improved VCT system performance and eliminating the need of offline calibration. Further, the variation of the VCT system over time, such as system degradation, may be taken into account during VCT control.

As one embodiment, a method for an engine includes adjusting a camshaft phaser with a camshaft duty cycle determined based on a sampled camshaft position; and adjusting the camshaft phaser with an estimated camshaft position determined based on the camshaft duty cycle between sampling the camshaft position. A first example of the method further comprises determining the estimated camshaft position by adding the sampled camshaft position with an estimated change in the camshaft position. A second example of the method optionally includes determining the estimated change in the camshaft position by integrating an estimated angular rate of the camshaft phaser determined based on the camshaft duty cycle. A third example of the method optionally includes one or more of the first and second examples, and further includes, wherein the estimated angular rate of the camshaft phaser is integrated in response to updating the sampled camshaft position. A fourth example of the method optionally includes one or more of the first through third examples, and further includes, wherein the estimated angular rate of the camshaft phaser is determined based on the camshaft duty cycle via an inverted rate-to-duty-cycle operator, the inverted rate-to-duty-cycle operator is a non-linear model of a variable camshaft timing system. A fifth example of the method optionally includes one or more of the first through fourth examples, and further includes, calibrating the inverted rate-to-duty-cycle operator online by optimizing a lookup table parameter vector based on a measured engine oil temperature and a measured angular rate of the camshaft phaser. A sixth example of the method optionally includes one or more of the first through fifth examples, and further includes, updating the inverted rate-to-duty-cycle operator online based on a measured engine oil temperature and a measured angular rate of the camshaft phaser. A seventh example of the method optionally includes one or more of the first through sixth examples, and further includes, generating the camshaft duty cycle based on a camshaft position error via a controller, the controller includes an error-to-rate operator connected in series with the rate-to-duty-cycle operator. A eighth example of the method optionally includes one or more of the first through seventh examples, and further includes, wherein the camshaft duty cycle is updated at a first frequency, the camshaft position is sampled at a second frequency, the second frequency lower than the first frequency. A ninth example of the method optionally includes one or more of the first through eighth examples, and further includes, wherein the estimated camshaft position is updated at the first frequency.

As another embodiment, a method comprises actuating an oil control valve of a variable camshaft timing system via a camshaft duty cycle; sampling a camshaft position at a first time point; estimating a camshaft position at a second time point based on the sampled camshaft position and the camshaft duty cycle; and updating the camshaft duty cycle based on the estimated camshaft position. A first example of the method further comprises estimating an angular rate of the camshaft phaser based on the camshaft duty cycle, and estimating the camshaft position by adding the sampled camshaft position with an integration of the estimated angular rate. A second example of the method optionally includes the first example and further includes, wherein the second time point is different from the first time point, and the estimated cam shaft position intermediates consecutive sampled camshaft positions. A third example of the method optionally includes one or more of the first and second examples, and further includes updating the camshaft duty cycle based on the sampled camshaft position at the first time point. A fourth example of the method optionally includes one or more of the first through third examples, and further includes, wherein the duration from the first time point to the second time point is shorter than a camshaft position sampling time period. A fifth example of the method optionally includes one or more of the first through fourth examples, and further includes, updating the camshaft duty cycle based on a camshaft position error between a desired camshaft position and a camshaft position feedback, wherein the camshaft position feedback is the summation of the sampled camshaft position and the estimated camshaft position.

As yet another embodiment, an engine system comprising: a cylinder; an intake valve and an exhaust valve coupled to the cylinder; a camshaft coupled to the intake and the exhaust valve; a camshaft phaser coupled to the camshaft; a sensor for sampling the position of the camshaft phaser; an oil control valve coupled to the camshaft phaser for adjusting a camshaft timing; and a controller configured with computer readable instructions stored on a non-transitory memory for: in response to an engine speed less than a threshold, actuating the oil control valve via a camshaft duty cycle determined based on a sampled position of the camshaft phaser and an estimated camshaft position, the estimated camshaft position determined based on a previously determined camshaft duty cycle. A first example of the system further includes configuring the controller for generating the camshaft duty cycle at a first time period, sensing the position of the camshaft phaser at a second time period, the second time period larger than the first time period. A second example of the system optionally includes the first example and further includes, configuring the controller for determining the estimated camshaft position between sampling the camshaft position. A third example of the system optionally includes one or more of the first through second examples, and further includes, configuring the controller for actuating the oil control valve via the camshaft duty cycle determined based on the sampled position of the camshaft phaser in response to an engine speed higher than the threshold.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A method comprising:

adjusting a camshaft phaser with a camshaft duty cycle determined based on a sampled camshaft position; and adjusting the camshaft phaser with an estimated camshaft position determined based on the camshaft duty cycle between sampling the camshaft position, wherein the estimated camshaft position is determined by adding the sampled camshaft position with an estimated change in the camshaft position.

2. The method of claim 1, further comprising determining the estimated change in the camshaft position by integrating an estimated angular rate of the camshaft phaser determined based on the camshaft duty cycle.

3. The method of claim 2, wherein the estimated angular rate of the camshaft phaser is integrated in response to updating the sampled camshaft position.

4. The method of claim 2, wherein the estimated angular rate of the camshaft phaser is determined based on the camshaft duty cycle via an inverted rate-to-duty-cycle operator, the inverted rate-to-duty-cycle operator is a non-linear model of a variable camshaft timing system.

5. The method of claim 4, further comprising calibrating the inverted rate-to-duty-cycle operator online by optimizing a lookup table parameter vector based on a measured engine oil temperature and a measured angular rate of the camshaft phaser.

6. The method of claim 4, further comprising updating the inverted rate-to-duty-cycle operator online based on a measured engine oil temperature and a measured angular rate of the camshaft phaser.

7. The method of claim 1, further comprising generating the camshaft duty cycle based on a camshaft position error via a controller with computer readable instructions stored in non-transitory memory, the controller includes an error-to-rate operator connected in series with the rate-to-duty-cycle operator.

8. The method of claim 1, wherein the camshaft duty cycle is updated at a first frequency, the camshaft position is sampled at a second frequency, the second frequency lower than the first frequency.

9. The method of claim 8, wherein the estimated camshaft position is updated at the first frequency.

10. A method comprising:

actuating an oil control valve of a variable camshaft timing system via a camshaft duty cycle;

sampling a camshaft position at a first time point;

estimating a second camshaft position at a second time point based on the sampled camshaft position and the camshaft duty cycle; and updating the camshaft duty cycle based on the estimated second camshaft position, wherein a duration from the first time point to the second time point is shorter than a camshaft position sampling time period.

11. The method of claim 10, wherein the second time point is different from the first time point, and the estimated cam shaft position intermediates consecutive sampled camshaft positions.

12. The method of claim 10, further comprising updating the camshaft duty cycle based on the sampled camshaft position at the first time point.

13. The method of claim 10, further comprising updating the camshaft duty cycle based on a camshaft position error between a desired camshaft position and a camshaft position feedback, wherein the camshaft position feedback includes the sampled camshaft position and the estimated second camshaft position.

14. A method comprising:

actuating an oil control valve of a variable camshaft timing system via a camshaft duty cycle;

sampling a camshaft position at a first time point;

estimating a second camshaft position at a second time point based on the sampled camshaft position and the camshaft duty cycle;

updating the camshaft duty cycle based on the estimated second camshaft position; and estimating an angular rate of a camshaft phaser based on the camshaft duty cycle, and determining the estimated second camshaft position by adding the sampled camshaft position with an integration of the estimated angular rate.

15. An engine system comprising:

a cylinder;

an intake valve and an exhaust valve coupled to the cylinder;

a camshaft coupled to the intake valve and the exhaust valve;

a camshaft phaser coupled to the camshaft;

a sensor for sampling a position of the camshaft phaser;

an oil control valve coupled to the camshaft phaser for adjusting a camshaft timing; and a controller configured with computer readable instructions stored on a non-transitory memory for:

in response to an engine speed less than a threshold, actuating the oil control valve via a camshaft duty cycle determined based on a sampled position of the camshaft phaser and an estimated camshaft position, the estimated camshaft position determined based on a previously determined camshaft duty cycle.

16. The method of claim 15, further comprising configuring the controller for generating the camshaft duty cycle at a first time period, sensing the position of the camshaft phaser at a second time period, the second time period larger than the first time period.

17. The method of claim 15, further comprising configuring the controller for determining the estimated camshaft position between sampling the camshaft position.

18. The method of claim 15, further comprising configuring the controller for actuating the oil control valve via the camshaft duty cycle determined based on the sampled position of the camshaft phaser in response to an engine speed higher than the threshold.

* * * * *